US007175303B2

(12) United States Patent
Kovacik et al.

(10) Patent No.: US 7,175,303 B2
(45) Date of Patent: Feb. 13, 2007

(54) LED UTILITY LIGHT

(75) Inventors: James D. Kovacik, Brecksville, OH (US); Paul S. Blanch, Broadview Heights, OH (US); Joseph J. Smith, Wooster, OH (US)

(73) Assignee: Alert Safety Lite Products Co., Inc, Bedford Heights, OH (US)

( * ) Notice: Subject to any disclaimer, the term of this patent is extended or adjusted under 35 U.S.C. 154(b) by 63 days.

(21) Appl. No.: 10/914,805

(22) Filed: Aug. 10, 2004

(65) Prior Publication Data

US 2005/0276045 A1 Dec. 15, 2005

Related U.S. Application Data

(63) Continuation-in-part of application No. 29/206,347, filed on May 28, 2004, now Pat. No. Des. 502,276.

(51) Int. Cl.
*F21V 11/00* (2006.01)

(52) U.S. Cl. ..... 362/240; 362/241; 362/245; 362/247; 362/399; 362/400; 362/800

(58) Field of Classification Search ..... 362/249, 362/800, 399, 400, 396, 241, 240, 237, 247, 362/369, 374, 375, 390, 252
See application file for complete search history.

(56) References Cited

U.S. PATENT DOCUMENTS 1,791,625 A * 2/1931 Kollath ..... 362/363
1,972,790 A * 9/1934 Olley ..... 362/294
2,874,270 A * 2/1959 Douglas et al. ..... 362/222
4,156,893 A * 5/1979 Baake ..... 362/222
4,442,984 A 4/1984 Bayat
4,774,647 A 9/1988 Kovacik et al.
4,929,199 A 5/1990 McKinnon
5,023,764 A 6/1991 McKinnon et al.
5,117,345 A * 5/1992 Baake ..... 362/390

(Continued)

FOREIGN PATENT DOCUMENTS

DE 198 02 998 8/1998

(Continued)

OTHER PUBLICATIONS

Ferret Worklite AC, Jun. 4, 2002, www.ferretinstruments.com.

(Continued)

*Primary Examiner*—Thomas M. Sember
(74) *Attorney, Agent, or Firm*—Butzel Long

(57) ABSTRACT

An LED utility light has a hollow housing with an upper light portion and a lower handle portion, the housing being formed by a rear shell and a front shell with a lens aperture formed therein. An LED circuit board assembly disposed in the housing has an array of LEDs arranged in rows facing the lens opening. A reflector member is mounted between the circuit board assembly and the lens opening and has a plurality of light apertures formed therein corresponding to the array with each LED being visible through an associated one of the light apertures, the reflector member having a reflective front surface. A lens member is mounted in the lens opening for passing light generated by the LEDs.

17 Claims, 5 Drawing Sheets

U.S. PATENT DOCUMENTS

| | | | | |
|---|---|---|---|---|
| D348,249 | S | 6/1994 | Hester | |
| 5,410,453 | A * | 4/1995 | Ruskouski | 362/20 |
| 5,436,815 | A * | 7/1995 | Grooms et al. | 362/216 |
| 5,700,089 | A | 12/1997 | McKinnon | |
| 5,818,234 | A | 10/1998 | McKinnon | |
| 5,921,658 | A | 7/1999 | Kovacik et al. | |
| 5,975,719 | A | 11/1999 | Reiff et al. | |
| D421,142 | S | 2/2000 | Bayat | |
| 6,260,442 | B1 | 7/2001 | Bayat | |
| 6,367,949 | B1 | 4/2002 | Pederson | |
| 6,386,736 | B1 | 5/2002 | Reiff et al. | |
| D483,508 | S | 12/2003 | Galvez | |
| D483,893 | S | 12/2003 | Galvez | |
| D484,628 | S | 12/2003 | Bayat et al. | |
| 6,663,265 | B2 | 12/2003 | Kovacik et al. | 362/375 |
| D486,599 | S | 2/2004 | Bayat et al. | |
| 6,857,756 | B2 * | 2/2005 | Reiff et al. | 362/184 |
| 6,902,295 | B2 * | 6/2005 | Galvez | 362/222 |
| 2002/0191396 | A1 | 12/2002 | Reiff et al. | |
| 2003/0039121 | A1 | 2/2003 | Nezigane | |
| 2003/0123254 | A1 | 7/2003 | Brass et al. | |
| 2003/0179572 | A1 | 9/2003 | Schnell | |
| 2004/0228124 | A1 * | 11/2004 | Reiff et al. | 362/184 |
| 2005/0265035 | A1 * | 12/2005 | Brass et al. | 362/451 |

FOREIGN PATENT DOCUMENTS

| | | |
|---|---|---|
| DE | 203 17 017 | 3/2004 |
| WO | WO 02/03761 | 1/2002 |

OTHER PUBLICATIONS

Bayco SL-2105, Bayco SL-2106, Apr. 1, 2003, www. budgetlighting.com.

* cited by examiner

LED UTILITY LIGHT

CROSS-REFERENCE TO RELATED APPLICATION

This application is a continuation-in-part of the U.S. design patent application Ser. No. 29/206,347 filed May 28, 2004 now U.S. Pat. No. D502,276.

BACKGROUND OF THE INVENTION

The present invention relates generally to illumination devices and, in particular, to an LED utility light.

Portable lights, which can be manually moved and suspended about a work site to aid a user to obtain the best lighting conditions, are well known. It has been the practice to use incandescent light bulbs, suitably encased in light guards, for this purpose. Such lights are often referred to as trouble lamps, extension lights, work lights, inspection lights, utility lights, and the like, and are commonly employed by mechanics and other workers who require a concentration of light while frequently changing locations. Such a trouble light is shown in the U.S. Pat. No. 4,774,647 to Kovacik et al.

Fluorescent lights have several advantages in use as compared with the incandescent bulbs. As an example, for the same wattage fluorescent lights usually provide more light with less glare. In the past, attempts have been made to convert portable lights such as extension lights to fluorescent tubes. For example, see the U.S. Pat. No. 5,921,658 to Kovacik et al.

Light emitting diodes (LEDs) are well known for providing illumination to digital displays and the like. It has become more common for a concentration of LEDs to be utilized for providing illumination. LEDs are particularly advantageous because of their low power consumption per candlepower produced when compared to incandescent light bulbs and, to a lesser degree, to fluorescent light bulbs.

The art continues to seek improvements. It is desirable to provide a portable light having lower power consumption that also provides sufficient illumination for a work site. It is also desirable to be able to place and orient the portable light in as many locations and positions as possible. It is always desirable to provide utility lamps that are lightweight and cost-effective to produce.

SUMMARY OF THE INVENTION

The present invention concerns an LED utility light including: a hollow housing having an upper light portion and a lower handle portion, the light portion having a lens aperture formed therein; an LED circuit board assembly disposed in the housing, the circuit board assembly including a plurality of LEDs arranged in a predetermined array and facing the lens opening; a reflector member mounted between the circuit board assembly and the lens opening, the reflector member having a plurality of light apertures formed therein corresponding to the array with each of the LEDs being visible through an associated one of the light apertures; and a lens member mounted in the lens opening for passing light generated by the LEDs.

The utility light includes a pair of upper cushions mounted on the light portion and a pair of handle cushions mounted on the handle portion. Each of the cushions has at least one attachment finger engaging a cutout in the housing.

The utility light includes a hook member rotatably attached to the housing for hanging and positioning the utility light.

The LEDs can be arranged in rows of three LEDs each and arrays of thirty LEDs and sixty LEDs are shown and described below. The light apertures are cone shaped and the reflector member has a reflective front surface.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
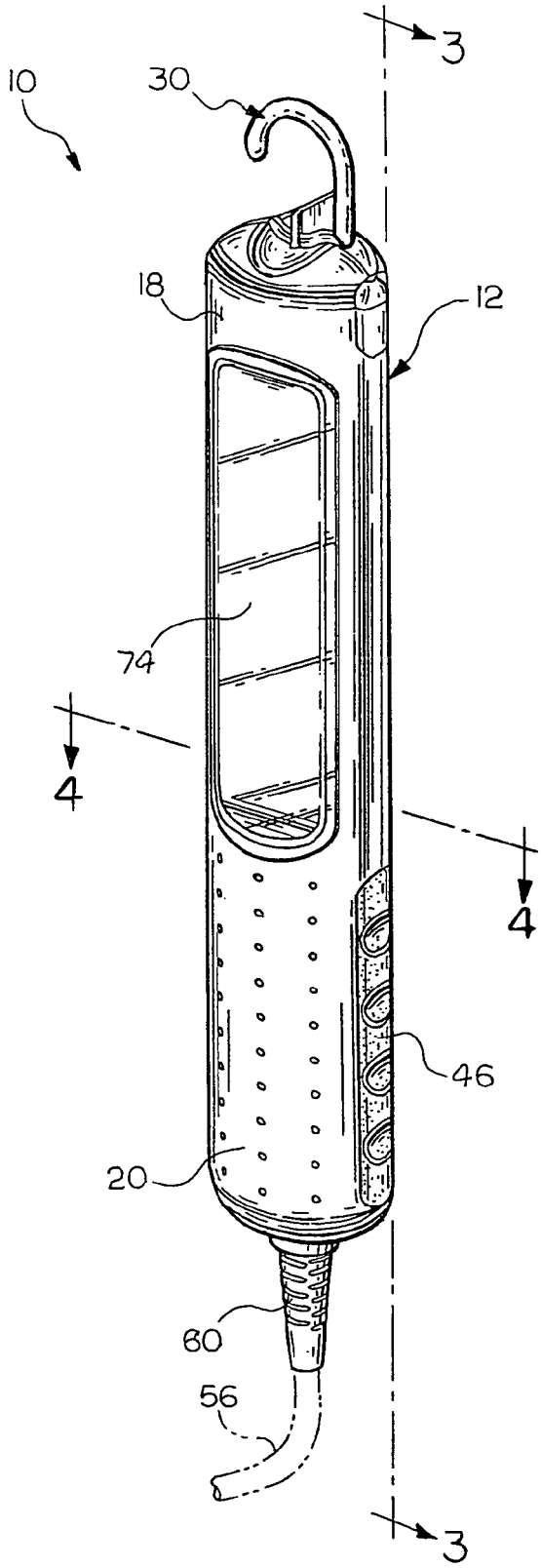
FIG. 1 is a perspective view of an LED utility light in accordance with the present invention.
Figure 2:
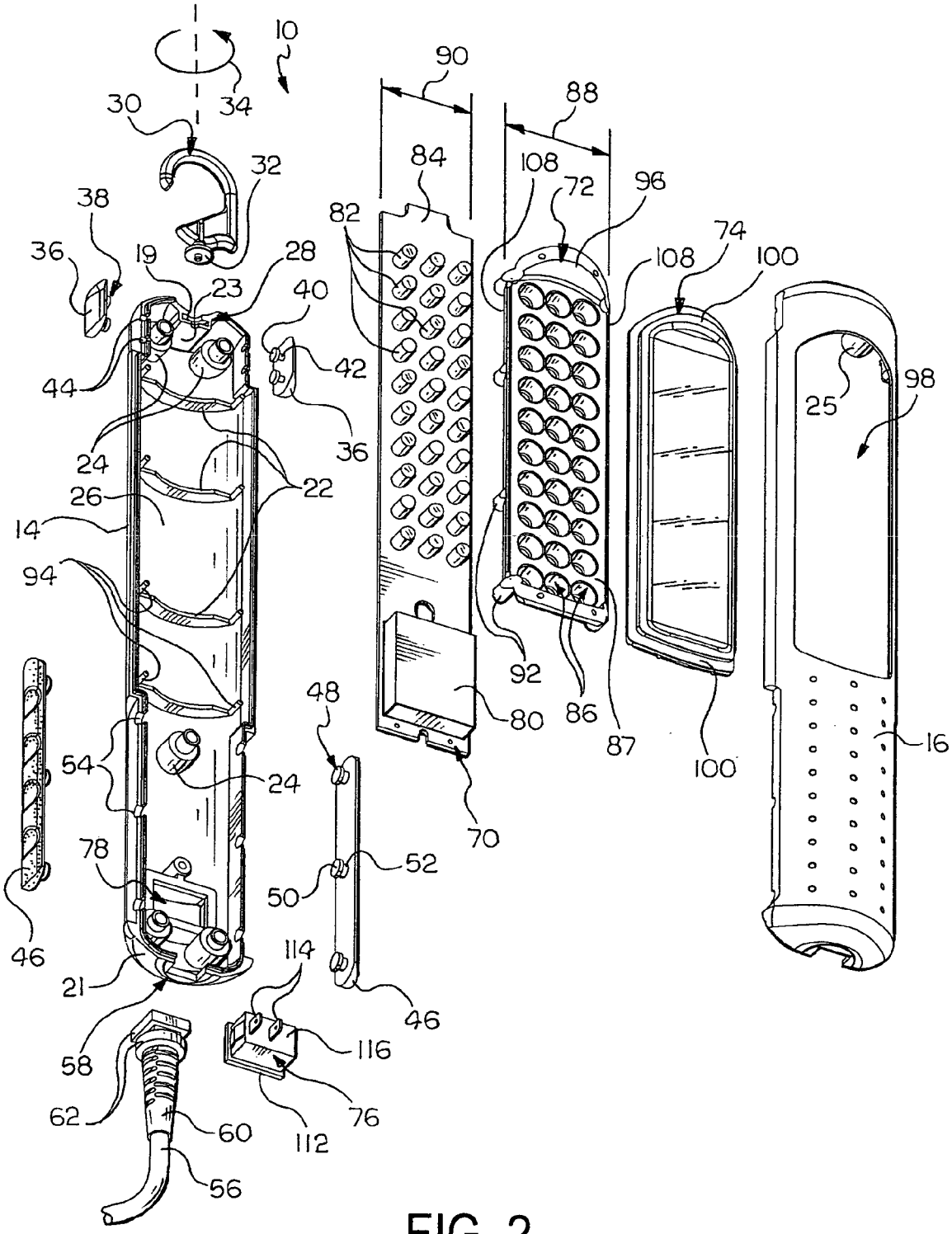
FIG. 2 is an exploded perspective view of the LED utility light of FIG. 1.

Referring now to FIGS. 1–4, an LED utility light in accordance with the present invention is indicated generally at 10. The utility light 10 includes a hollow light housing 12 split on a vertical plane into a rear housing shell 14 and a front housing shell 16. When attached, the housing shells 14 and 16 define an elongated upper light portion 18 extending from a lower handle portion 20. The housing shells 14 and 16 are substantially arcuate in cross section and, when attached, form the housing 12 with a substantially oval cross section. The housing 12 is preferably formed of a lightweight material, such as plastic or the like, as the utility light 10 is contemplated to be both handheld and portable. The rear housing shell 14 includes a plurality of strengthening ribs 22 (FIG. 2) extending generally horizontally across interior walls thereof. A plurality of tubular bosses 24 extend from an inner surface 26 of the rear housing shell 14 for receiving respective fasteners (not shown) inserted into corresponding apertures (not shown) formed in the shell 14. The fasteners extend through the bosses 24 into corresponding posts 25 that extend from an inner surface 27 of the front housing shell 16 to secure the shells 14 and 16 together to form the housing 12, discussed in more detail below.

An upper portion of the each of the housing shells 14 and 16 is formed to define a recess or cavity 28 for receiving a disk portion 32 of a hook member 30. The disk portion 32 is trapped between a top wall 19 and an interior wall 23 of the shells 14 and 16 defining the recess 28. After the shells 14 and 16 are joined, a shank portion 31 of the hook 30 extends upwardly from the disk portion 32 through an aperture formed in the top wall 19 and a post 33 extends downwardly from the disk portion 32 through an aperture formed in the interior wall 23 allowing the hook 30 to rotate freely about a longitudinal axis of the utility light 10 as shown by an arrow 34 in FIG. 2. The hook member 30, therefore, provides a means for hanging and orienting the utility light 10 during use.

Each one of a pair of upper cushions 36 includes a plurality of attachment fingers 38 having a stop portion 40 and a shaft portion 42. The upper cushions 36 are each attached to the light portion 18 of the housing 12 by placing the shaft portion 42 of the attachment fingers 38 in corresponding grooves or cutouts 44 formed in facing side edges of the rear shell 14 and the front shell 16 of the housing 12. The stop portions 40 prevent removal of the cushions 36 from the housing 12 after the housing 12 has been assembled, as discussed in more detail below. Similarly, each one of a pair of elongated handle cushions 46 includes a plurality of attachment fingers 48 having a stop portion 50 and a shaft portion 52. The handle cushions 46 are each attached to the handle portion 20 of the housing 12 by placing the shaft portion 52 of the attachment fingers 48 in corresponding grooves or cutouts 54 formed in facing side edges of the rear shell 14 and the front shell 16 of the housing 12. The stop portions 50 prevent removal of the cushions 46 from the housing 12 after the housing 12 has been assembled. The upper cushions 36 and the handle cushions 46 are each preferably constructed of a soft, easily deflectable material.

A power cord 56 extends through an aperture 58 in a bottom wall 21 of the handle portion 20 and is used to provide power to the circuitry, discussed below, that is enclosed within the housing 12. A split member strain relief means 60 is attached to the power cord 56. The diameter of the strain relief means 60 gradually tapers outwardly to a pair of spaced radial projections 62 that overlap an edge 64 of the bottom wall 21 defining the aperture 58 to retain the power cord 56 in place should a pulling force be applied to the power cord 56. The projections 62 absorb any forces so that the electrical connections with the circuitry may be maintained. The end of the power cord 56 has a male plug (not shown) for insertion into a common female electrical power receptacle (not shown) to obtain AC power.

The hollow housing 12 defines a space between the rear shell 14 and the front shell 16 thereof for receiving a plurality of lighting components, including an LED circuit board assembly 70, a reflector member 72, a lens member 74, and a switch 76. The switch 76 is disposed in an aperture 78 formed in the rear shell 14 of the housing 12 and electrically connects power from a power source (not shown) connected to the power cord 56 to an inlet of a conventional AC/DC power converter 80 or the like on the LED circuit board assembly 70. The LED circuit board assembly 70 includes a plurality of LEDs 82 extending from a front surface 84 thereof. In the example shown, thirty LEDs 82 are arranged in an array having ten rows of three LEDs each. The LEDs 82 are connected in parallel to an output of the converter 80 and are operable to emit light in a well-known manner when a DC voltage is provided by the converter.

The reflector member 72 is in the form of a planar mask that fits over the front surface 84 of the LED circuit board assembly 70. The reflector member 72 includes a plurality of spaced apart apertures 86 formed therein. A front surface 87 of the reflector member 72 is preferably mirror chrome plated or has a similar highly reflective surface. The number and spacing of the apertures 86 corresponds to the number of the LEDs 82 on the circuit board assembly 70. The walls of the reflector member 72 that define each of the apertures 86 are also mirror chrome plated and taper radially outwardly from the adjacent front surface 84 to the front surface 87 to form a generally cone-shape profile, best seen in FIGS. 3 and 4. A width, indicated by an arrow 88, of the reflector member 72 is greater than a width, indicated by an arrow 90, of the circuit board assembly 70. A plurality of spaced support legs 92 extend from a rear surface of the reflector member 72 along side edges thereof. The spacing between the support legs 92 at opposed sides of the reflector member 72 is greater than the width 90 of the circuit board assembly 70 so that the support legs 92 extend beyond the side edges of the circuit board assembly 70 and engage with corresponding support pins 94 extending upwardly from outer edges of the support ribs 22 of the rear housing shell 14. A pair of brackets 96 extends from upper and lower ends respectively of the reflector member 72. Each of the brackets 96 is arched away from the front surface 87 and has opposite ends attached at opposite sides of the reflector member 72, best seen in FIGS. 2 and 3.

The lens member 74 is received in an aperture 98 extending through an upper portion of the front housing shell 16 during assembly of the utility light 10. The lens member 74 is preferably constructed of clear plastic material or similar material. The lens member 74 includes a surrounding flange 100 that is trapped between the brackets 96 and a periphery 102 of the front shell 16 (FIG. 3) surrounding the aperture 98.

Figure 4:
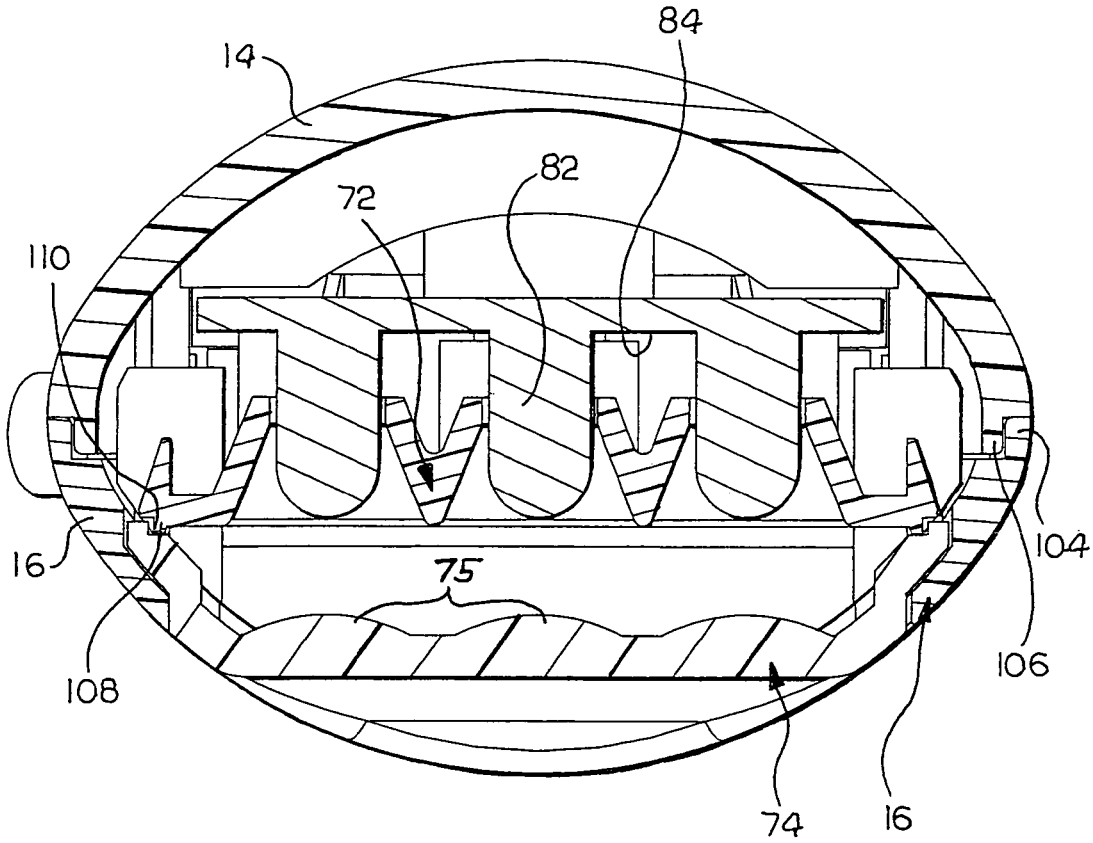
FIG. 4 is a cross-sectional view taken along line 4—4 in FIG. 1.

Referring to FIG. 4, the front housing shell 16 has a peripheral flange 104 on the outer edge that overlaps a cooperating peripheral flange 106 on the outer edge of the rear housing shell 14 when the shells are secured together by fasteners (not shown) extending through the bosses 24 engaged in corresponding posts 25. The reflector 72 preferably includes a projection 108 extending from each side edge of the front surface 87 for cooperating with a corresponding groove 110 formed in a facing surface of the flange 100 of the lens member 74. The cooperating projections 108 and grooves 110 assist in aligning the lens member 74 with the reflector 72.

Figure 3:
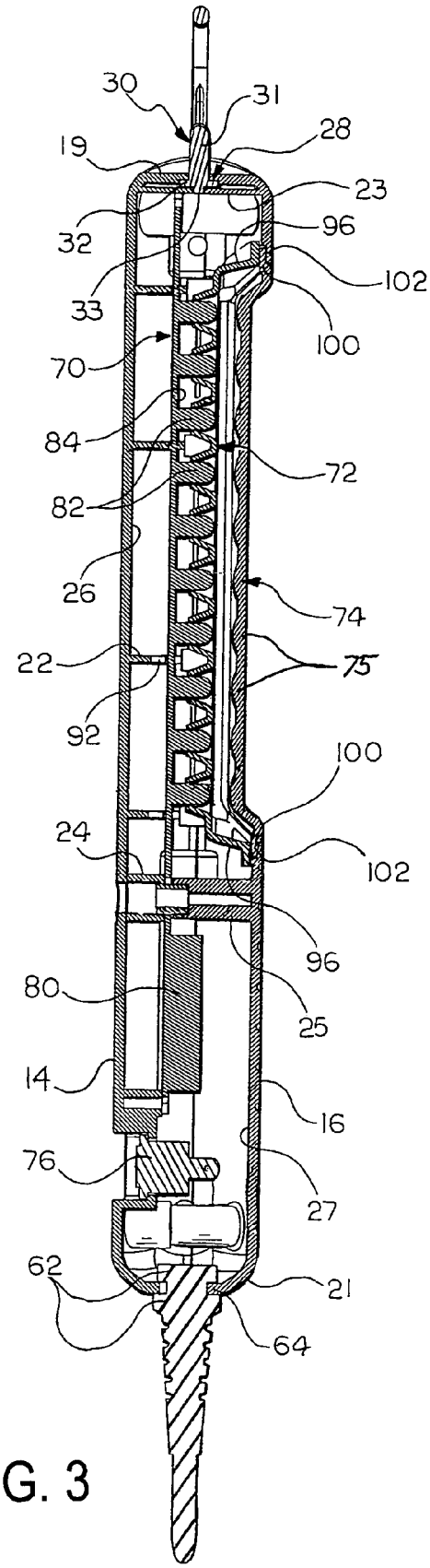
FIG. 3 is a cross-sectional view taken along line 3—3 in FIG. 1.

As seen in FIGS. 3 and 4, the lens member 74 has a plurality of focusing portions 75 that correspond in number and position to the LEDs 82. Each of the focusing portions 75 is formed as a convex protrusion on the rear surface of the lens member 74 facing the reflector member 72. The focusing portions 75 collect and focus light from the corresponding LEDs 82 to generate a collective focused beam of light exiting the lens member 74. However, the rear surface of the lens member 74 could be flat, so that no focusing is provided, or the areas adjacent the LEDs 82 could be formed with concave shapes, so that the light exiting the lens member 74 is dispersed for a flood light effect.

Figure 5:
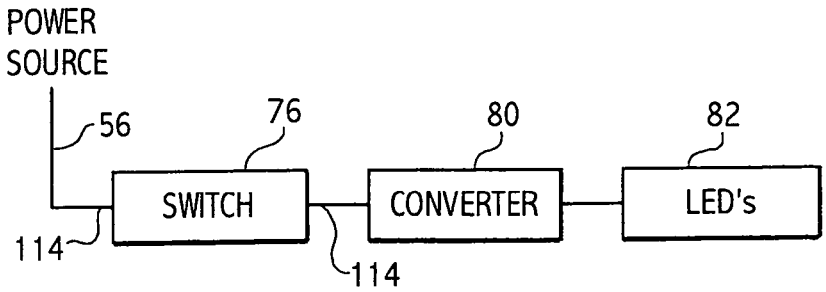
FIG. 5 is an electrical schematic of an LED utility light in accordance with the present invention.

The switch 76 includes a switch housing 112 with a pair of electrical terminals 114 extending from a rear surface 116 thereof and a switch rocker (not shown) on a front surface opposite the surface 116. One of the terminals 114 is connected to the power source through the power cord 56 and the other of the terminals 114 is connected to the input to the converter 80 on the circuit board assembly 70 (FIG. 5). The switch 76 is selectively actuatable to provide AC power from the power source to the circuit board assembly 70. The switch 76 is easily actuated by a thumb or finger of a person (not shown) holding the handle portion 20 to light the LEDs 82 of the circuit board assembly 70 with one hand while also orienting the light 10 with the same hand.

Figure 6:
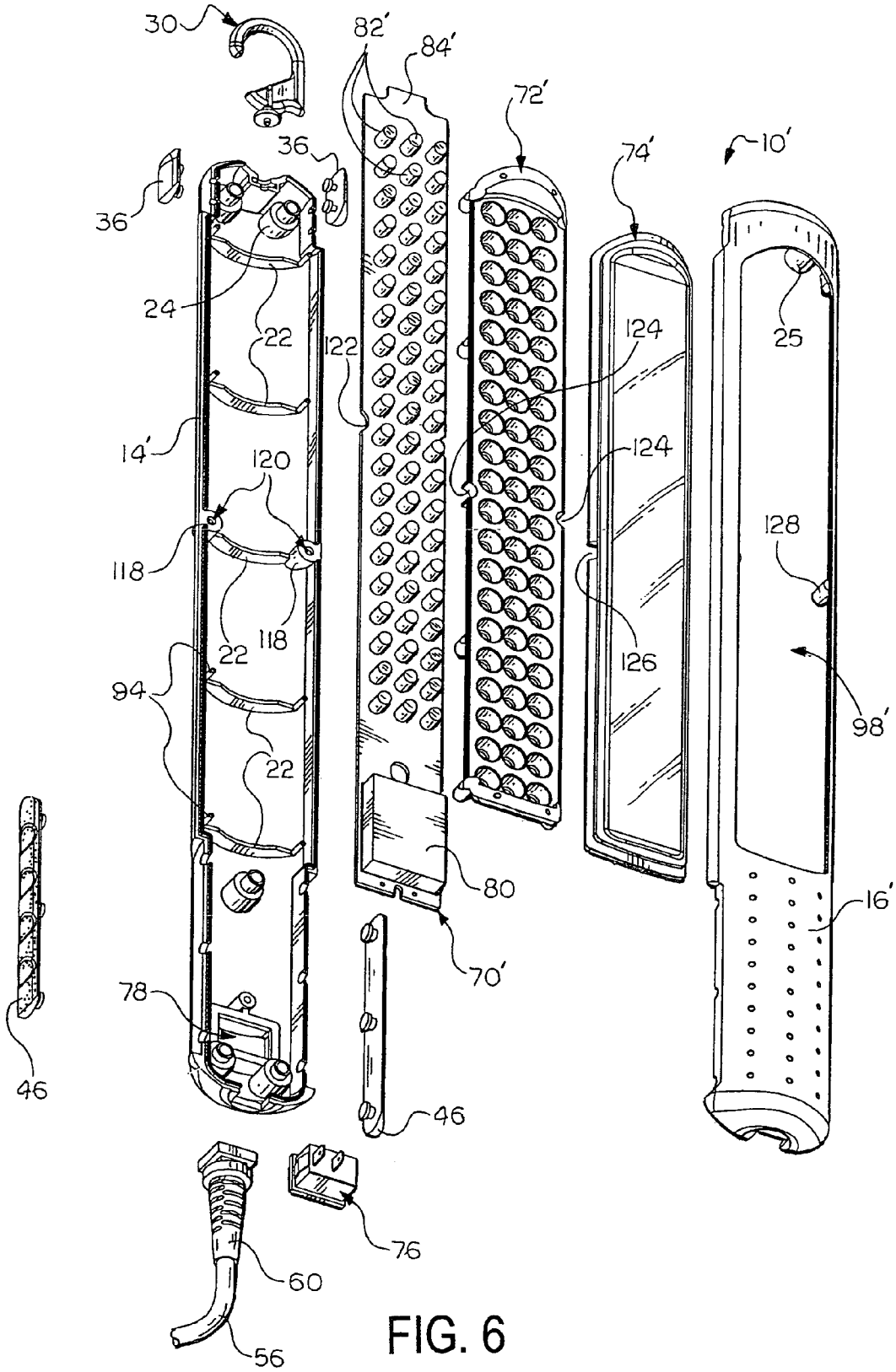
FIG. 6 is an exploded perspective view of an alternative embodiment of an LED utility light in accordance with the present invention.

Referring now to FIG. 6, an alternative embodiment of a utility light in accordance with the present invention is indicated generally at 10'. The utility light 10' includes many elements common with the utility light 10 shown in FIGS. 1–4, and some reference numerals are omitted for clarity. The utility light 10' includes a vertically split hollow light housing 12' formed from a rear housing shell 14' and a front housing shell 16'. When attached, the housing shells 14' and 16' define an elongated upper light portion 18' extending from a hollow lower handle portion 20'. The housing 12' differs mainly from the housing 12 by being taller to accommodate additional LEDs 82. A center one of the strengthening ribs 22 has at opposite ends thereof, instead of the support pins 94, a pair of bosses 118 each including a through aperture 120 for receiving a fastener (not shown).

The hollow housing 12' defines a space between the rear shell 14' and the front shell 16' for receiving a plurality of lighting components, including an LED circuit board assembly 70', a reflector member 72', a lens member 74', and the switch 76. The LED circuit board assembly 70', the reflector member 72', and the lens member 74' are correspondingly greater in length than the LED circuit board assembly 70, the reflector member 72, and the lens member 74 respectively due to an increased number of the LEDs 82. As shown, sixty LEDs 82 are arranged in an array of twenty rows of three LEDs each. Those skilled in the art will appreciate that the length of the utility light according to the present invention may be selected to be greater or less than the lengths of the housings 12 and 12' depending upon the number and the shape of the array of the LEDs 82.

In order to accommodate the bosses 118, a recess 122 is formed in the opposite sides of the circuit board assembly 70', a recess 124 is formed in opposite sides of the reflector member 72', and a recess 126 is formed in opposite sides of the lens member 74'. The recesses 122, 124, and 126 accommodate the bosses 118 and corresponding posts 128 extending from the front housing shell 16' to receive the fasteners (not shown) when the housing shells 14' and 16' are assembled. The electrical schematic for the utility light 10' is substantially as shown in FIG. 5.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An LED utility light, comprising:

a hollow housing having an upper light portion and a lower handle portion, said light portion having a lens aperture formed therein;

at least one cushion attached to said housing and exposed at an exterior surface of said housing;

an LED circuit board assembly disposed in said housing, said circuit board assembly including a plurality of LEDs arranged in a predetermined may and facing said lens opening;

a reflector member mounted between said circuit board assembly and said lens opening, said reflector member having a plurality of light apertures formed therein corresponding to said array with each of said LEDs being visible through an associated one of said light apertures; and a lens member mounted in said lens opening for passing light generated by said LEDs, wherein at least one projection is formed on said reflector member and at least one groove is formed in said lens member, said at least one projection and said at least one groove cooperating to align said reflector member with said lens member.

2. The utility light according to claim 1 wherein said at least one cushion has at least one attachment finger engaging a cutout in said housing.

3. The utility light according to claim 1 wherein said at least one cushion is one of an upper cushion mounted on said light portion and a handle cushion mounted on said handle portion.

4. The utility light according to claim 1 including a hook member rotatably attached to said housing.

5. The utility light according to claim 1 including at least one support leg extending from said reflector member and engaging a support pin extending from an inner surface of said housing.

6. The utility light according to claim 1 wherein said LEDs are arranged in rows of three LEDs each.

7. The utility light according to claim 1 wherein said plurality of LEDs includes at least thirty LEDs.

8. The utility light according to claim 1 wherein said light apertures are cone shaped.

9. The utility light according to claim 1 wherein said reflector member has a reflective front surface.

10. The utility light according to claim 1 wherein said lens member has a plurality of focusing portions formed thereon facing said LEDs for focusing light generated by said LEDs.

11. An LED utility light, comprising:

a hollow housing having an upper light portion and a lower handle portion, said housing being formed by a rear shell and a front shell, said front shell having a lens aperture formed in said light portion;

an LED circuit board assembly disposed in said housing, said circuit board assembly including a plurality of LEDs arranged in a predetermined array and facing said lens opening;

a reflector member mounted between said circuit board assembly and said lens opening, said reflector member having a plurality of light apertures formed therein corresponding to said array with each of said LEDs being visible through an associated one of said light apertures;

at least one support leg extending from said reflector member and engaging a support pin extending from an inner surface of said housing; and a lens member mounted in said lens opening for passing light generated by said LEDs.

12. The utility light according to claim 11 including a pair of cushions attached to opposite sides of said light portion of said housing.

13. The utility light according to claim 11 including pair of handle cushions mounted on opposite sides of said handle portion.

14. The utility light according to claim 11 including a hook member rotatably attached to said housing.

15. The utility light according to claim 11 including at least one projection formed on said reflector member and at least one groove formed in said lens member, said at least one projection and said at least one groove cooperating to align said reflector member with said lens member.

16. The utility light according to claim 11 wherein said LEDs are arranged in at least ten rows of three LEDs each.

17. An LED utility light, comprising;

a hollow housing having an upper light portion and a lower handle portion, said housing being formed by a rear shell and a front shell, said front shell having a lens aperture formed in said light portion;

at least one handle cushion mounted on said handle portion and exposed at an exterior surface of said handle portion;

an LED circuit board assembly disposed in said housing, said circuit board assembly including a plurality of LEDs arranged in a predetermined array and facing said lens opening;

a reflector member mounted between said circuit board assembly and said lens opening, said reflector member having a plurality of light apertures formed therein corresponding to said array wit each of said LEDs being visible through an associated one of said light apertures, said reflector member having a reflective front surface; and a lens member mounted in said lens opening for passing light generated by said LEDs, wherein at least one projection is formed on said reflector member and at least one groove is formed in said lens member, said at least one projection and said at least one groove cooperating to align said reflector member with said lens member.

* * * * *